United States Patent [19]

Hodgson

[11] 4,056,451

[45] Nov. 1, 1977

[54] DUAL FIELD ELECTRIC TREATER

[75] Inventor: Robert A. Hodgson, Tulsa, Okla.

[73] Assignee: Maloney-Crawford Tank Corporation, Tulsa, Okla.

[21] Appl. No.: 671,090

[22] Filed: Mar. 29, 1976

[51] Int. Cl.[2] ..... C10G 33/02

[52] U.S. Cl. ..... 204/305

[58] Field of Search ..... 204/302–308, 204/188, 191

[56] References Cited

U.S. PATENT DOCUMENTS

| | | | |
|---|---|---|---|
| 2,855,356 | 10/1958 | Stenzel | 204/188 |
| 2,894,895 | 7/1959 | Turner | 204/302 |
| 3,794,578 | 2/1974 | Watson | 204/305 |
| 3,847,775 | 11/1974 | Prestridge | 204/191 |
| 3,898,152 | 8/1975 | Hodgson | 204/308 |

*Primary Examiner*—John H. Mack

*Assistant Examiner*—Aaron Weisstuch

*Attorney, Agent, or Firm*—Head, Johnson & Chafin

[57] ABSTRACT

An electric treater for separation of a water-in-oil emulsion, which utilizes both AC potential applied to electrodes as well as DC potentials. A plurality of trays are provided through which the emulsion passes in series. One or more of these trays is supplied with AC potential to a series of insulated electrodes. Another tray is provided with a DC potential obtained from one half of a secondary winding of a transformer, through a rectifier, and at least a third tray is provided with a second DC potential derived from the opposite end of the secondary winding through a separate rectifier. The oil to be treated first passes through the tray or trays which have the AC potential, and then passes successively through the two trays which have the pulsed DC potential.

7 Claims, 7 Drawing Figures

DUAL FIELD ELECTRIC TREATER

CROSS-REFERENCE TO RELATED PATENT

This application is related to U.S. Pat. No. 3,898,152, issued Aug. 5, 1975, in the name of Robert A. Hodgson. The title of the patent is "Electrostatic Wet Oil Treater." This U.S. Pat. No. 3,898,152 is incorporated by reference into this application.

BACKGROUND OF THE INVENTION

This invention lies in the field of oil field emulsion treating equipment.

More specifically, this invention lies in the field of electrical emulsion treaters which separate globules of water from oil in a water-in-oil emulsion, by providing AC potentials or pulsed DC potentials between insulated electrodes and the metal surfaces of the treater, to coalesce small droplets to form large ones, which will separate out from the oil.

In the prior art it has long been known that oil field emulsions can be broken or separated by the use of electrostatic fields applied to the emulsion as it flows between a pair of electrodes. The electrical field causes water droplets to be charged and to be attracted to one or the other of the electrodes. In moving toward the electrode, they collide and coalesce with other droplets, to form larger droplets, which by their size then fall in the earth's gravity field, to collect on the bottom of the tank.

It has been found that AC potentials are useful in separating and removing large water droplets in a water-in-oil emulsion. However, for small droplets, a DC potential is preferred. However, in applying a continuous DC potential, it sometimes happens that a continuous string or thread of droplets is formed, which connect between the two electrodes and, therefore, forms a low resistance connection. This can cause damage and burning of the electrodes, and possibly an explosion of the treater tank. Therefore, if DC potentials are used, they must be interrupted in one way or another such as by electrical switching, or by the mechanical separation of electrodes, etc.

It is a primary object of this invention to provide an electrical treater for oil field emulsions, that has a plurality of treating trays with AC potential applied to the electrodes in one or more of the trays, through which the emulsion is first passed, and pulsed DC potentials applied to electrodes in two or more additional trays through which the partially treated oil from the first trays are successively passed.

It is a further object of this invention to provide at least two trays which are supplied separately with pulsed DC potentials in which the pulsed DC potentials are derived from half-wave rectifiers, which rectify alternate half cycles of an AC potential. With pairs of such trays, one tray will carry a rectified potential from one end of the secondary of a transformer, and another tray will carry the rectified output from the opposite end of the secondary of the transformer, with the midpoint of the secondary being grounded to the equipment.

SUMMARY OF THE INVENTION

These and other objects are realized, and the limitations of the prior art are overcome in this invention by providing a more or less conventional multi-tray oil field emulsion treater, with at least three trays. A first tray, or first plurality of trays, are supplied on their insulated electrodes with an AC potential, as is well known in the art. A second group of trays through which the treated oil successively passes, are arranged in at least one pair, and each of the trays in the pair are connected to opposite ends of an AC transformer secondary through rectifiers, the centertrap being grounded, so that the half-wave rectification of the secondary voltage is applied separately to the two trays in the pair, such that one is carrying potential when the other is not, and vice versa.

In this way, the transformer secondary is fully loaded, in that on each reversal of potential the transformer carries a current substantially equal to the current it carried on the previous half cycle, and it is, therefore, uniformly loaded. Furthermore, the DC electrical potential applied to each of the trays in a pair are pulsed DC, the potential being a half-wave rectified current with uni-directional pulses separated by half cycles of zero potential. The half cycles on each of the trays being 180° in phase from each other.

BRIEF DESCRIPTION OF THE DRAWINGS

These and other objects and advantages of the present invention and a better understanding of the principles and details of the invention will be evident from the following description taken in conjunction with the appended drawings in which.

DESCRIPTION OF THE PREFERRED EMBODIMENT

Figure 1:
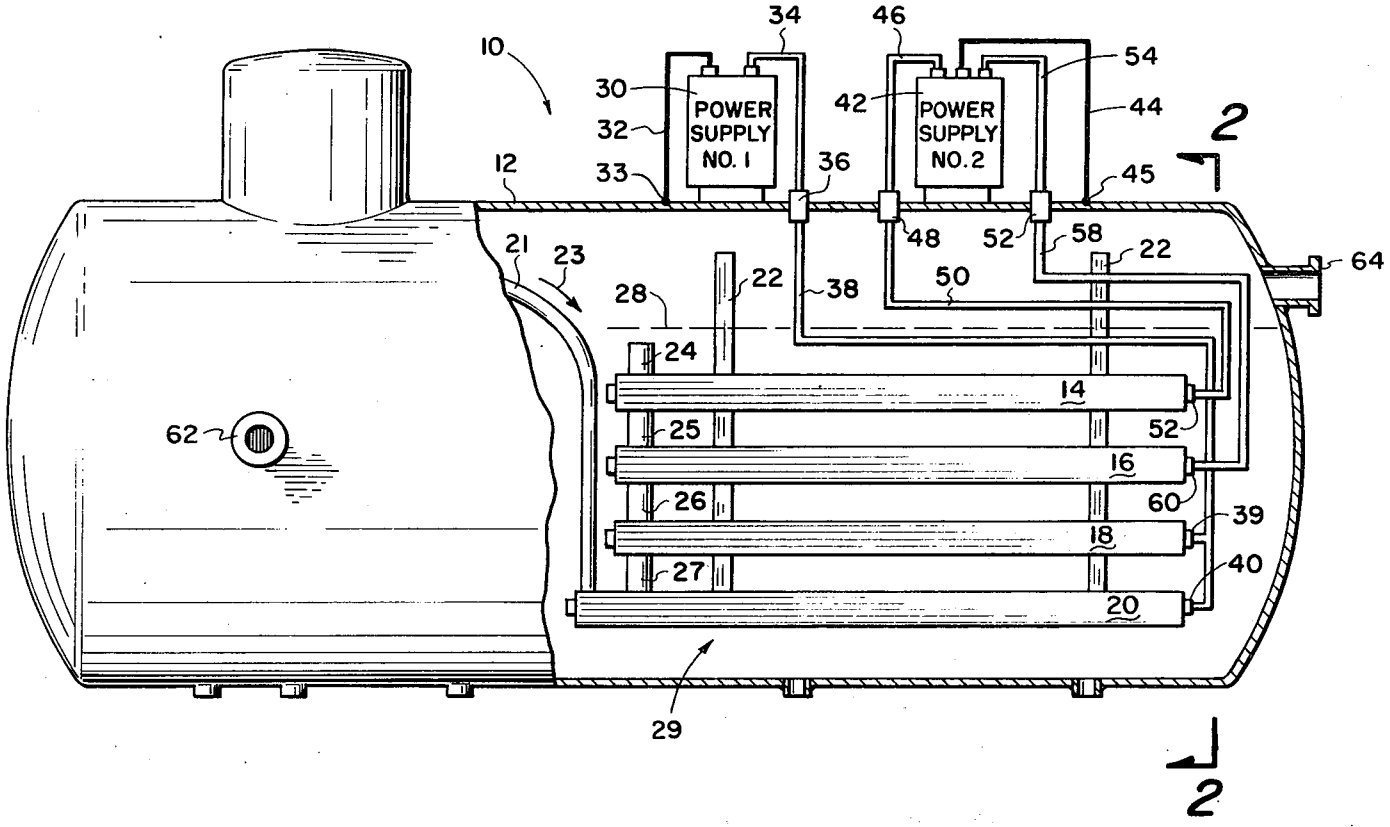
FIG. 1 is a partial open view of one embodiment of this invention.

Referring now to the drawings, FIG. 1 is patterned after FIG. 1 of U.S. Pat. No. 3,898,152 and shows a treater indicated generally by the numeral 10, of which one portion is cross-sectioned to show the construction of the interior apparatus. Since U.S. Pat. No. 3,898,152 is incorporated by reference into this application, reference is made to that patent for a detailed description of the entire interior construction of the treater 10, and an explanation of its operation.

The treater 10 has an outer tank or vessel 12, generally of a circular cylindrical shape with horizontal axis, although there is no limitation to the shape, size and orientation. Inside of the treater are a plurality 29 of trays 14, 16, 18 and 20 which are supported in a horizontal position one above the other by means of vertical supports 22, which are attached to the interior surface of the outer wall 12 of the vessel.

The oil field emulsion to be broken or separated is inserted through a pipe 62, which is horizontal, and passes through the wall 12 of the treater 10. After some internal mechanical flow and separation, the oil passes by a means of plurality of pipes 21 in accordance with arrow 23, downward into the lowest tray 20 in the stack of trays 29.

These trays are rather complicated in construction; and for a full detailed description and method of operation, reference is made to the U.S. Pat. No. 3,898,152 previously mentioned. The purpose of these trays is to provide a long, tortuous flow channel for the water-in-oil emulsion, during the time of passage of which it can be subjected to an electrostatic field, either alternating or direct.

Figure 2:
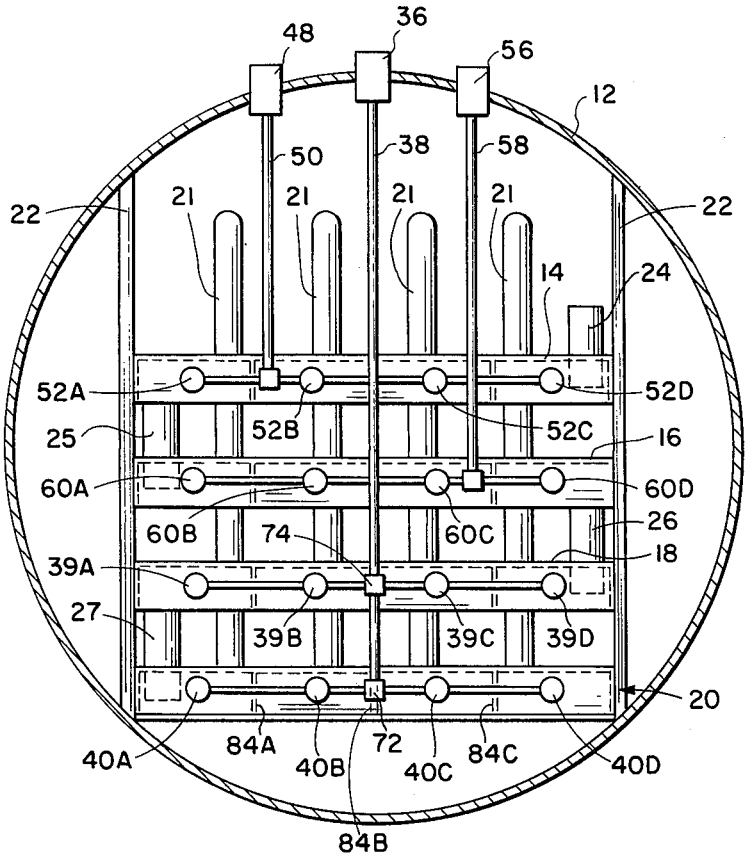
FIG. 2 is a vertical section taken along plane 2—2 of FIG. 1.
Figure 3:
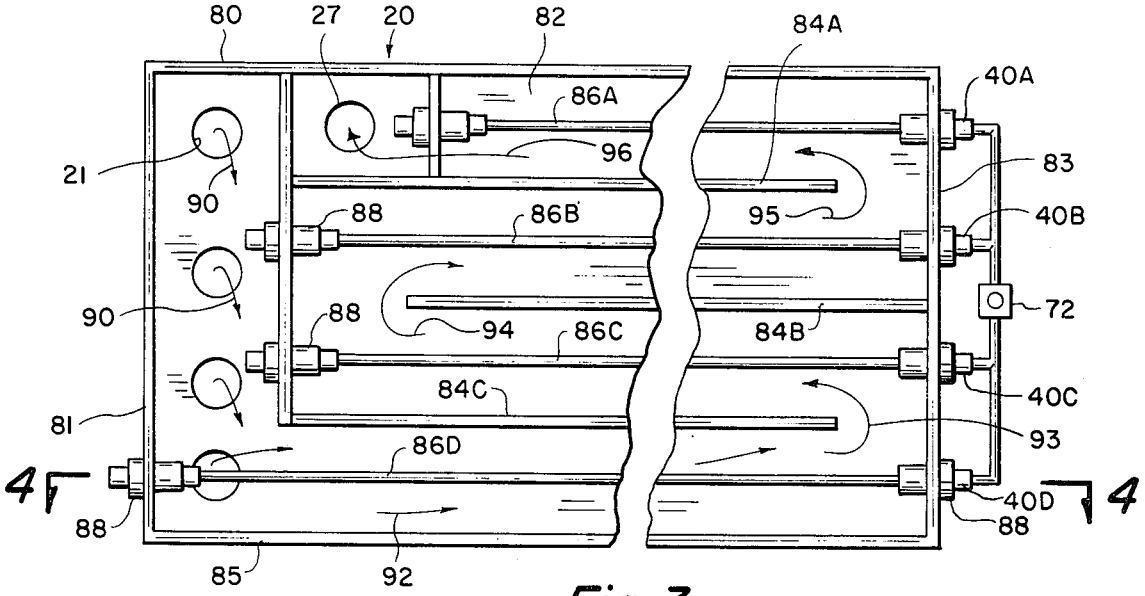
FIG. 3 is a view of one of the trays showing the sequential passages for the flow of oil, and the positions of the insulated electrodes.

FIG. 3 shows a bottom view of the lowest tray 20, and shows the ends of the pipes 21 that intersect the top surface 82 of the tray. The oil flows in accordance with arrows 90 out of these pipes 21 into a longitudinal channel between the outside wall 85 and a barrier wall 84C, the flow of oil going by way of arrow 92 and around the end of the barrier 84C in accordance with arrow 93, and then along the channel provided between barriers 84C and 84B, and around the end of the barrier 84B, in accordance with arrow 94, into the channel between barrier 84B and 84A, and in accordance with arrow 95 into the channel between barrier 84A and the wall 80 of the tray 20. At the end of the last flow channel, there is a vertical pipe 27 into which the oil flows; and as shown in FIG. 2, the oil flows upwardly into the next tray above, namely, tray 18, and so on as will be further described.

While four series channels are shown with one coaxial electrode in each, it will be clear that there can be more or fewer channel segments in each tray, and the number four is shown by way of illustration only.

There are a group of electrodes 86A, 86B, 86C, and 86D positioned symmetrically in the four channels, which make up the total path for oil flow from the inlet pipes 21 and out of the pipe 27. These electrodes can be iron rods, or made of other metals. They are supported in the end walls 81, 83, etc. of the tray by means of insulating bushings 88, as will be further described in connection with FIG. 4.

Each of the four electrodes in a tray are connected by insulated electrical conductors 40A, 40B, 40C, and 40D, to an electrical junction 72, and thence by electrical insulated conductor as in FIG. 1, indicated by numeral 38. This conductor passes through an insulating bushing 36 in the wall of the treater to a conductor 34 from a power supply 30 which is mounted on or near to the treater. The second electrical output from the power supply 30 is connected by lead 32 and connection 33 to the wall of the treater itself, which forms a ground connection; and through the supporting structure 22, this ground connection is carried to each of the four trays.

It will be clear that when AC potential is applied between the ground, that is, the metal of the tray itself and the insulated longitudinal electrodes 86, there will be an electrostatic field between the electrodes 86 and the walls of the channel, including the upper plate 82, which forms one wall of the channel. The view of the tray in FIG. 3 is a bottom view and indicates that, except for the area where the oil flows into and out of the tray, the remaining portions of the channels are open on the bottom. This is satisfactory since in the channel the oil will flow above the water and there will be an oil-water interface indicated as dashed line 87 in FIG. 4.

As is well known in the art, an electrical potential applied to the electrode such as 86D in the channel formed between the walls 85 and 84C and 82, will set up an electrical field which will cause the movement of charged droplets of water in the emulsion to be moved toward the metal surfaces and to coalesce with other droplets, to form large drops, and to collect in the bottom of the treater tank. In FIG. 1, the horizontal dashed line 28 near the upper portion of the tank is indicated as the working oil-water interface, the tank being full of water below that level and filled with oil and gas above that level. Also, in the trays as will be shown in FIG. 4, the dashed line 87 indicates the oil-water interface in the oil flowing in the channels.

Indicated in the U.S. Pat. No. 3,898,152 is a set of four horizontal trays, spaced one above the other, and all of the electrodes in all of the trays are tied together electrically and supplied with an alternating potential so that the AC field is set up in each of the four channels of each of the four trays.

What is different about this installation in FIGS. 1 and 2 is that while one or more of the trays, namely, those into which the untreated oil is first flowed and which presumably will have fairly large drops of water, these trays are treated with alternating potential. Presumably, as the oil flows through the various channels, the larger water droplets will be separated out and collected, and the smaller droplets which are less affected by the AC potential will remain in the oil. The third and fourth trays are separately connected to different DC potentials so that the oil is successively treated by pulsed DC potentials to provide better separation of the smaller droplets and, therefore, provide more complete removal of the water.

Figure 4:
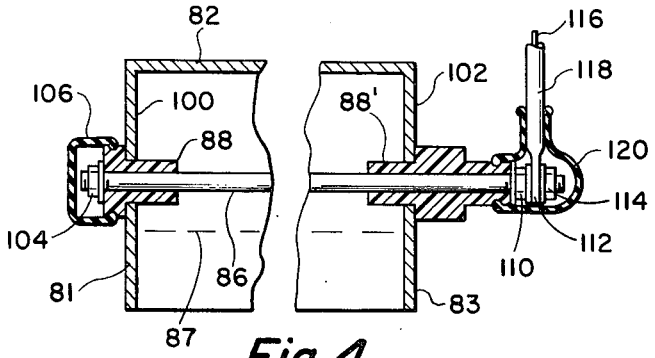
FIG. 4 is a detail of FIG. 3 showing the electrical insulation.

It is clear that since the volume of liquid in the tank below the level 28 is water, which is generally salty, and, therefore, highly conducting, all of the electrical connections inside of the tank to the electrodes must be insulated. One way of doing this is illustrated in FIG. 4, which is a cross-section along the plane 4—4 of FIG. 3. Indicated are the walls 81 and 83 of the tray 20, and the coverplate 82 which forms the top of the tray. The electrodes are rods such as 86 which are supported in insulated bushings 88, 88' which may be made of vitreous or plastic material. The rods are threaded on the ends and tightly supported in the tray by means of nuts 104, 110, and 114. Where the rod is just supported, such as at the left end of bushing 88 in the wall 81, a flexible insulating plastic or rubber covering 106 is provided to insulate the end 104 of the electrodes from the ambient water. At the other end of the electrode where the lead is brought in, the lead wire shown as 116 is in an insulating sheath 118 and is attached by lug 112 to the electrode 86 and held by nut 114. An insulating sleeve of flexible plastic or rubber material 120 is then positioned over the insulating bushing 88', and the insulating sheath 118, to provide a complete insulating surface for the conductor 116.

Figure 5:
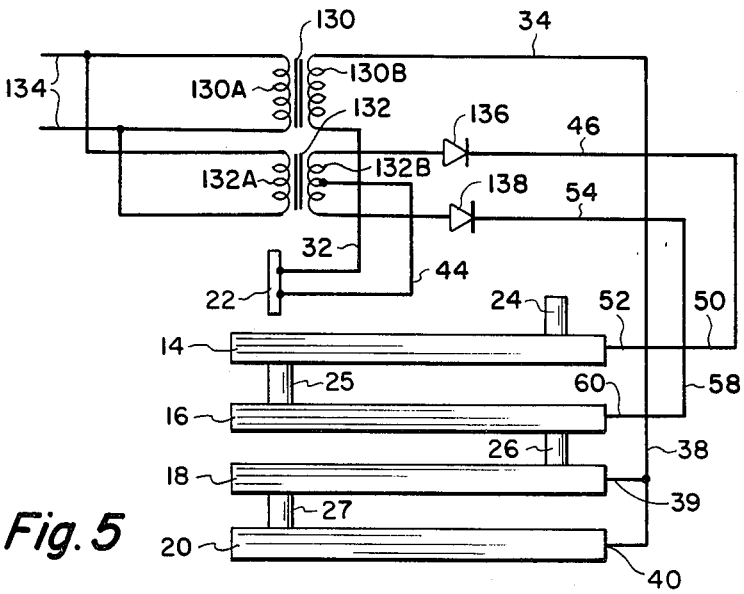
FIGS. 5 and 6 represent schematically the electrical connections to the trays and the resulting voltage and current wave forms.

Referring now to FIG. 5, there is shown in schematic fashion the four trays 14, 16, 18, and 20, and two electrical transformers 130 and 132, having primary windings 130A and 132A, each connected to the power supply 134 through appropriate switches, not shown, as is well known. The transformer 130 has a single secondary winding 130B, one terminal of which is connected by lead 32 to the metal of the tank and the supports 22. The other terminal of the secondary 130B goes by leads 34 and 38 to the terminals 39 and 40 of trays 18 and 20, respectively.

The second transformer 132 has a secondary winding 132B. The mid tap of the secondary is connected by lead 44 to ground similar to lead 32. The two ends of the secondary 132B are connected respectively through rectifiers 136 and 138. One output, through rectifier 136, goes by way of leads 46 and 50 to terminal 52 on the tray 14. The output of the other rectifier 138 goes by leads 54 and 58 to terminal 60 on tray 16.

The oil is brought in through the pipes 21 into the tray 20, out of the tray through a riser 27 into the tray 18, through that tray and out through a riser 26 into tray 16, and through riser 25 into tray 14, and out through riser 24 into the interior of the tank. The treated oil flows up through the oil-water interface 28 into the oil above the interface, and out through the outlet pipe 64 from the end wall of the tank. The oil flow first passes through the two trays 20 and 18, which are supplied with AC potential on the electrodes, and then through the two trays 16 and 14, each of which is supplied with pulsed DC potential. Thus, the successive treatments will provide the maximum separation of water.

Figure 6:
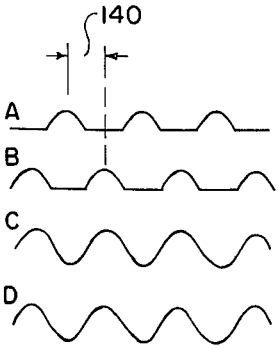

Referring now to FIG. 6, there is shown in four curves A, B, C, D, the electrical potential on the electrodes in the four trays, which correspond to these four wave shapes. Wave shapes C and D are similar, being full wave sinusoidal alternating potentials. Wave shapes B and A are half-wave rectified potentials, being half waves of sinusoids, the half waves in A being out of phase by 180° from the half waves in B. This provides a full and balanced load on the transformer 132.

FIG. 2 illustrates in a vertical section the arrangements of the four trays 14, 16, 18, and 20 and the corresponding riser pipes 24, 25, 26 and 27, and the inlet pipes 21. Shown also are the electrical connections 38, from the electrodes in the two lower trays 20 and 18, 50 from the upper tray 14, and 58 from the intermediate tray 16. While four trays are shown, there can be any number, except that it is desirable to have as many trays connected to lead 50 as there are connected to lead 58, so as to balance the load on the transformer 132. There can be as many trays as desired connected in parallel with full AC potential to the lead 38. Each of the three leads 50, 38, and 58 are brought out through insulated bushings on the tank wall 12 to the two power sources shown in FIG. 1 and schematically in FIG. 5.

In FIG. 5, two separate power transformers 130, 132 are shown. It will be clear that there can be one transformer, having one primary and two separate secondaries, or as shown in FIG. 7, there can be one transformer with one primary and one secondary, with a mid tap on that secondary grounded to the tank itself.

Figure 7:
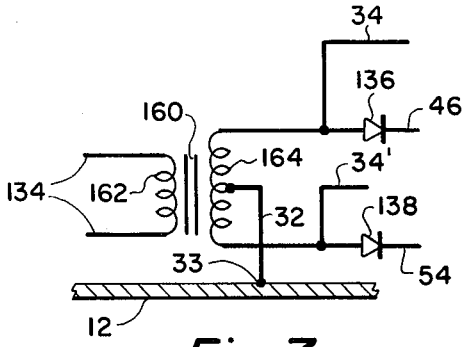
FIG. 7 represents a further modification of the circuit of FIG. 5.

In FIG. 7, there is a single power transformer 160 which has a primary winding 162 connected to the power supply 134. There is a single secondary winding 164, the mid tap of which is connected by lead 32 to the tank wall 12 at 33. Two alternating current leads 34 and 34' are connected across the outer ends of the secondary 164. Now, instead of having one lead 34 going to both trays 18 and 20, one tray would be fed with power from lead 34, and the other tray would be fed by lead 34', again providing a balanced load on the transformer from the two lower trays.

The terminals of secondary winding 164 would continue to the rectifiers 136 and 138 as in FIG. 5, and through leads 46 and 54, also as in FIG. 5.

It is clear that the electrical connections as shown in FIG. 7 will provide the full equivalent of those in FIG. 5 with considerable simplification in equipment. The pulse interval may be made sufficiently long so that no chance of continuous threads of water could be formed between the electrodes, a much greater treating capacity can be provided since the DC potential is applied for a longer period than simply a half cycle, and may be up to three quarters or seven eighths of a full cycle.

What has been described is an electrically controlled system which makes it possible from a single treater to combine electrical treatments in which the flowing water-in-oil emulsion is treated with AC potential in one or more trays to remove large droplets, while in succeeding trays it is treated with pulsed DC potential to remove the smaller droplets. The pulsed DC potential can be provided by half-wave rectifiers, successive trays being handled by half-wave pulses of current which are out of phase by 180°.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. In an oil field electrical emulsion treater having a plurality of trays through which the emulsion is passed sequentially, the improvement comprising:

a. at least one first tray means comprising at least one insulatively mounted electrode therein, and means to apply an AC potential between said electrode and the walls of said first tray;

b. at least one additional pair of trays, each pair comprising a second tray and a third tray, at least one insulatively mounted electrode in each of said second and third trays, and means to apply unidirectional pulsed half wave rectified potential between said electrodes in said second and third trays and the walls of each respective tray, the half waves in said second tray being out of phase by 180° with the half waves in said third tray.

2. The treater as in claim 1 including means to flow the emulsion to be treated through said first tray and then through said second and said third trays.

3. The treater as in claim 1 wherein said first tray means comprises a plurality of first trays, each with at least one insulatively mounted electrode, and means to apply said AC potential between each said electrode and the walls of each of said plurality of first trays.

4. The treater as in claim 1 in which said means to apply said unidirectional pulsed half wave rectified potential to said electrodes in said second and third trays comprises:

a. a transformer having primary and secondary windings;

b. a first terminal of said secondary winding connected through a first rectifier to said second tray electrode;

c. a second terminal of said secondary winding connected through a second rectifier to said third tray electrode; and d. a center tap of said secondary winding connected to said second and third trays of said treater.

5. The treater as in claim 4 in which said AC potential is obtained from a different transformer winding than that from which said unidirectional pulsed DC potential is obtained.

6. The treater as in claim 4 in which said AC potential is obtained from the same transformer winding, as that from which said unidirectional pulsed potential is obtained, and including two first trays, and means to connect at least one said electrode in each said first tray respectively to said first terminal and to said second terminal of said winding.

7. The treater as in claim 1 in which each of said trays comprise a plurality of narrow channels through which said emulsion successively passes.

* * * * *